US005857895A

United States Patent [19]

Falchieri

[11] Patent Number: 5,857,895

[45] Date of Patent: Jan. 12, 1999

[54] CHECKING DEVICE FOR A MICROFINISHING MACHINE TOOL

[75] Inventor: Giordano Falchieri, Bologna, Italy

[73] Assignee: Marposs Societa' per Azioni, Bentivoglio, Italy

[21] Appl. No.: 849,350

[22] PCT Filed: Dec. 15, 1995

[86] PCT No.: PCT/EP95/04971

§ 371 Date: Jun. 6, 1997

§ 102(e) Date: Jun. 6, 1997

[87] PCT Pub. No.: WO96/20068

PCT Pub. Date: Jul. 4, 1996

[30] Foreign Application Priority Data

Dec. 27, 1994 [IT] Italy ..... BO94A0578

[51] Int. Cl.[6] ..... B24B 49/00; B24B 51/00

[52] U.S. Cl. ..... 451/8; 451/5; 451/25

[58] Field of Search ..... 451/25, 5, 8, 51, 451/251, 296, 303, 307, 9, 24, 1, 2

[56] References Cited

U.S. PATENT DOCUMENTS

| | | | |
|---|---|---|---|
| 1,815,049 | 7/1931 | Cole | 451/25 |
| 1,911,890 | 5/1933 | Fraser | 451/25 |
| 2,521,979 | 9/1950 | Jagen | 451/25 |
| 3,862,517 | 1/1975 | Porter, Jr. | 451/25 |
| 3,863,400 | 2/1975 | Rossi | 451/25 |
| 3,898,440 | 8/1975 | Fukuma et al. | 451/25 |
| 5,095,663 | 3/1992 | Judge et al. | 451/25 |
| 5,148,636 | 9/1992 | Judge et al. | 451/304 |
| 5,150,545 | 9/1992 | Esteve | 451/25 |
| 5,245,793 | 9/1993 | Schmitz | 451/14 |
| 5,251,405 | 10/1993 | Clauss et al. | 451/25 |
| 5,311,704 | 5/1994 | Barton, II et al. | 451/10 |
| 5,447,463 | 9/1995 | Schmitz | 451/14 |
| 5,529,529 | 6/1996 | Judge et al. | 451/51 |
| 5,531,631 | 7/1996 | Judge | 451/5 |

FOREIGN PATENT DOCUMENTS

| | | |
|---|---|---|
| 0 382 336 | 8/1990 | European Pat. Off. . |
| WO 95/29791 | 11/1995 | WIPO . |

*Primary Examiner*—David A. Scherbel
*Assistant Examiner*—Derris H. Banks
*Attorney, Agent, or Firm*—Dickstein Shapiro Morin & Oshinsky LLP

[57] ABSTRACT

A microfinishing machine tool comprising an abrasive belt and reference and clamping shoes for the machining of a cylindrical surface of a workpiece. In order to perform a checking, in the course of machining, of dimensions and geometrical characteristics on the cylindrical surface, a detecting device comprises a support element coupled to a shoe in a central limited area and two pairs of gauging heads coupled to the support element for detecting diametral dimensions at two different cross sections of the cylindrical surface. The shoe comprises seats and openings for housing the detecting device.

15 Claims, 4 Drawing Sheets

CHECKING DEVICE FOR A MICROFINISHING MACHINE TOOL

DESCRIPTION

1. Technical Field

The present invention relates to a device for checking dimensional characteristics of a surface with rotational symmetry of a workpiece, in the course of the machining in a microfinishing machine that comprises two movable shoes and at least an abrasive belt, arranged between one of the shoes and the workpiece, with at least one pair of gauging heads with associated movable feelers for contacting diametrically opposite portions of the cylindrical surface to be checked at a cross-section of the cylindrical surface, each gauging head comprising a transducer for providing electrical signals depending on the position of the associated movable feeler and a processing unit, electrically connected to the gauging heads, for receiving and processing said electrical signals.

The invention also relates to a microfinishing machine tool for machining cylindrical surfaces of a workpiece, comprising means for supporting and for driving the workpiece, adapted for defining a longitudinal axis of rotation and causing rotational displacements of the workpiece about said axis, at least an abrasive belt for machining the surface of the workpiece, a machining structure, with two oppositely arranged shoes bearing surfaces for providing a mechanical reference for the surface to be machined, the shoes being adapted to symmetrically approach to, and displace away from, each other for pressing the abrasive belt against the surface to be machined, and control means with a control and processing unit for controlling the displacements of the shoes and the workpiece, and a detecting device.

2. Background Art

Microfinishing machine tools can be utilized for machining external surfaces of workpieces, like crankshafts or camshafts, subsequently to the machining in grinding machines, for removing any after-grinding defects, like surface imperfections, and obtaining particularly accurate finishing. At times, some of the aforementioned machines can be used in the place of grinding machines.

The specific structure of a microfinishing machine comprises, generally, in respect of every surface to be machined, two oppositely arranged shoes for clamping and for reference purposes, and abrasive tools that are pressed against the surface by the shoes, while the workpiece is undergoing rotation for machining purposes.

The tools can consist of, for example, abrasive stones mounted upon at least one of the shoes or one or more abrasive belts pressed against areas of the surface to be machined by portions of the shoes.

The possibility of controlling a "microfinishing" cycle in an automatic way depends on the possibility of accomplishing an "in-process" gauging cycle of the "microfinishing" cycle; in other terms, checking, in a substantially uninterrupted way during the machining operation, the diametral dimensions and the geometrical characteristics of the involved surface, and consequently controlling the stopping of the machining and/or the adjustment of parts of the machine for compensating, for example, any detected shape errors.

According to a possible application, during automatic machining of the crankpins of a crankshaft any taper error on the cylindrical surfaces of the crankpins can be automatically corrected.

The difficulties in performing the in-process gauging derive from the specific structure of the machine, that limits in a considerable way access to the surface to be checked, the latter being narrow and enclosed between the shoes. The difficulties increase in the case of belt microfinishing machines, owing to the tool surrounding part of the surface.

DISCLOSURE OF THE INVENTION

Object of the invention is to overcome the foregoing difficulties and performing a particularly reliable automatic checking of the machining in microfinishing machines, in particular belt microfinishing machines for cylindrical surfaces.

A further object is to carry out an in-process gauging of the geometrical characteristics of cylindrical surfaces, comprising, for example, the automatic detecting of possible taper errors on said surfaces.

These and other objects and advantages are attained by a device that, according to the invention, comprises a support element, coupled to one of the shoes, and in which the gauging heads of said pair are coupled to the support element, and the support element comprises a central coupling portion, coupled to the associated shoe in a central limited area of the shoe.

The above objects are also attained by a microfinishing machine tool wherein, according to the invention, the detecting device comprises a support element coupled to one of the shoes at a central limited area of the shoe, and at least a pair of gauging heads coupled to the support element, each comprising a movable arm, a feeler coupled to an end of the movable arm, fulcrum means enabling displacements of the movable arm with respect to the support element, and a transducer providing to the processing and control unit electrical signals depending on the position of the feeler.

An important result, attained by a device and a machine according to the present invention, consists in the possibility of performing very accurate in-process checkings of dimensions and geometrical characteristics, by virtue of the specific coupling of the element supporting the gauging heads to the associated shoe, that enables to mechanically insulate the device, and prevent, in substance, any strains and deformations—that the shoe may undergo—from being transmitted to the heads and to those portions of the support element where the gauging heads are coupled to.

Moreover, a considerable advantage offered by the present invention consists in the extremely small overall dimensions of the checking device, hence enabling to perform in-process gauging also during automatic machining in those cases in which the shoes occupy almost all the space available in view of the particular shape of the workpiece (for example in the machining of crankpins of crankshafts).

A still further important advantage that the invention provides consists in the possibility of checking, even in the case of extremely limited overall dimensions, not only the diametral dimensions, but also geometrical characteristics of the workpieces, like taper errors on cylindrical surfaces.

BRIEF DESCRIPTION OF THE DRAWINGS

The invention is now described in detail—for illustrative and non limiting purposes—with reference to the enclosed sheets of drawings, wherein.

BEST MODE FOR CARRYING OUT THE INVENTION

Figure 1:
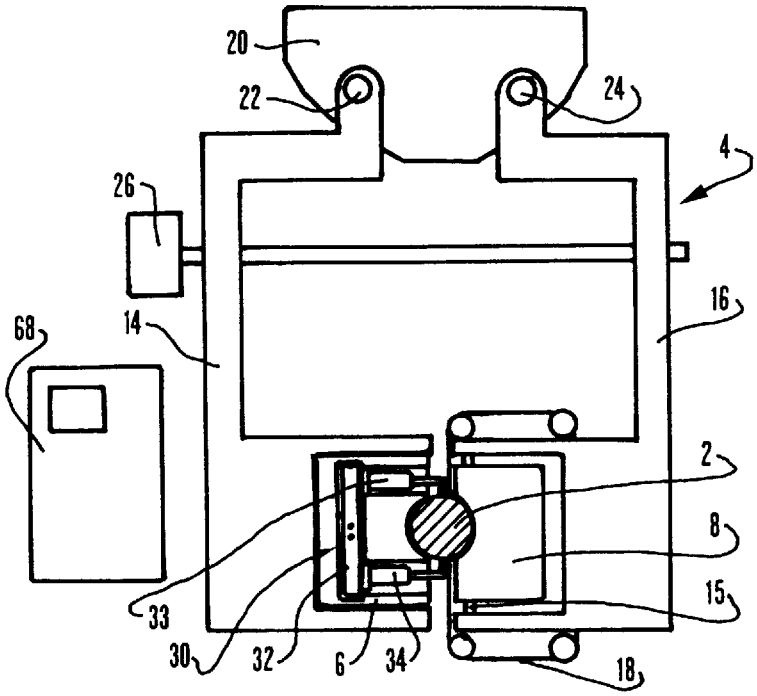
FIG. 1 is a schematic cross-sectional view of a microfinishing machine tool according to the invention.

The machine, schematically shown in FIGS. 1–5, is used for microfinishing the cylindrical surface 1 of a workpiece 2, and comprises a machining structure 4 with two oppositely arranged shoes 6, 8 that define associated mechanical reference surfaces 10, 12. Shoe 6 is coupled to a rotating element 14 in a known way, for example by a rigid coupling, not shown in the figures. Shoe 8 is coupled to a rotating element 16 by means of a transversal pin 15, and an abrasive belt 18 is supported by the rotating element 16 in such a way that a working portion of the belt 18 is arranged at the reference surface 12. Belt 18 periodically undergoes a feed motion, effected by means of suitable devices schematically shown in FIG. 1, for the purposes of renewing the machining section.

It should be realized that shoe 6 can be coupled to the associated element 14 in a different manner with respect to what has been schematically shown in the figures, for example by means of a transversal pin, arranged in a similar way as pin 15 of shoe 8, or by means of a different device, that allows limited oscillations of shoe 6 for ensuring matching between the mechanical reference surface 10 and the cylindrical surface 1 to be checked. The rotating elements 14, 16 are in turn coupled to a frame 20 by means of fulcra, schematically shown in FIG. 1 and marked by reference numbers 22, 24, and are coupled to each other by means of a drive device 26, for obtaining symmetrical rotational displacements of shoes 6, 8, to close towards workpiece 2, and pressing the portion of belt 18 arranged between reference surface 12 and the surface 1 to be machined, as shown in FIG. 1.

Means for checking the machining of surface 1 comprise a detecting device 30 coupled to shoe 6 for gauging the diametral dimensions of surface 1.

Figure 5:
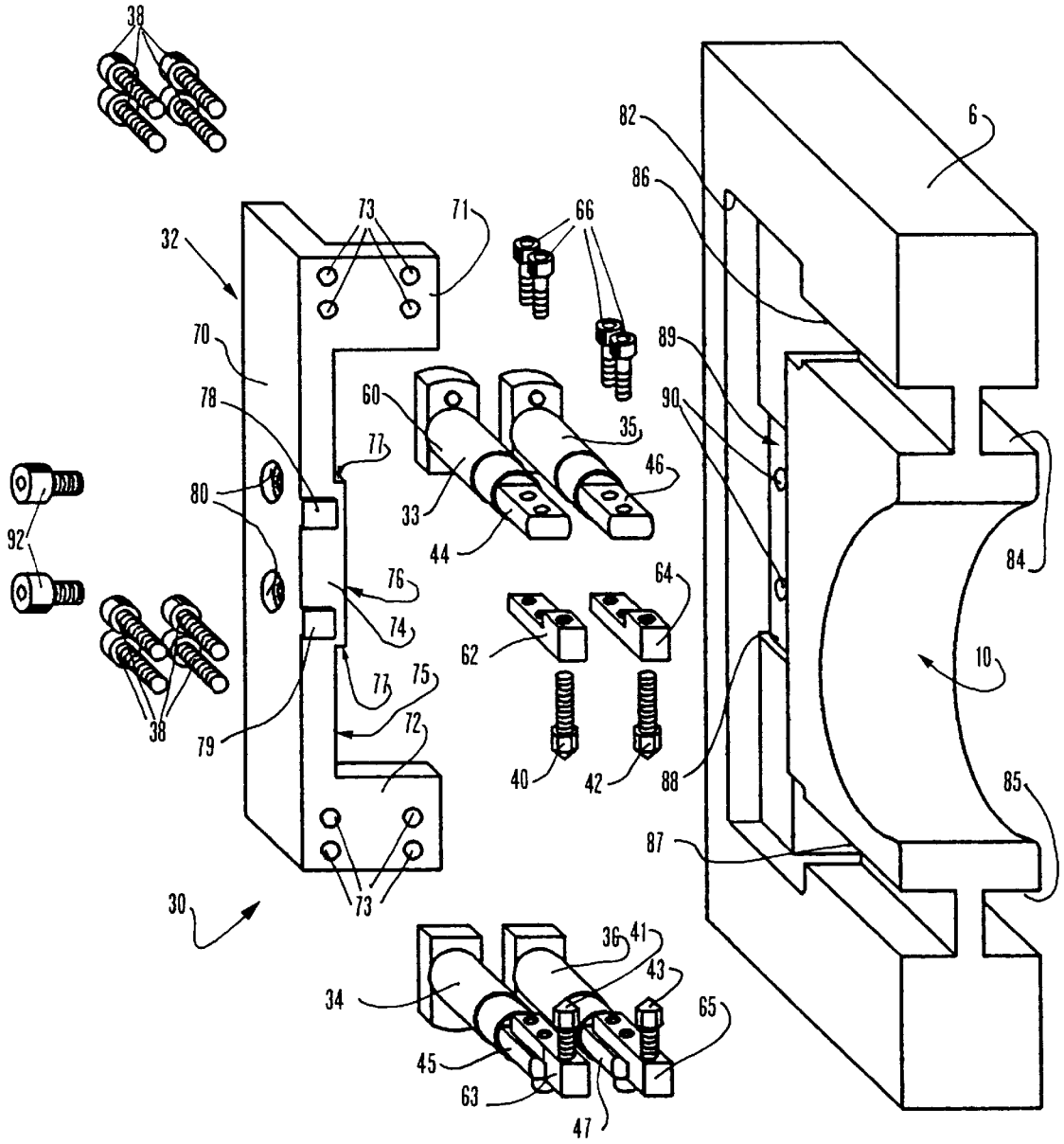
FIG. 5 is an exploded perspective view of some details of the machine shown in FIGS. 2 and 3.

Device 30 comprises a support element 32 and two pairs of gauging heads 33, 34 and 35, 36, for example of the electromechanical type, coupled to the support element by means of pairs of screws identified by reference number 38 in FIG. 5. Gauging heads 33–36 comprise feelers 40, 41, 42, 43 and movable arms 44, 45, 46, 47, respectively, with identical structure as that of head 33, schematically shown in FIG. 2. More specifically, each gauging head comprises a substantially integral armset 50, defining the movable arm 44, a fixed part 52, rigidly coupled to the support element 32, and a flexible portion with smaller thickness 54 that defines an axis of rotation, in particular due to resilient bending enabling rotational displacements of arm 44 with respect to the fixed part 52. Adjustable abutments 56 are coupled to the fixed part 52 for cooperating with arm 44 and limiting its rotational displacements. An inductive type transducer, identified by reference number 58 in the drawing, comprises two reciprocally movable parts (windings and core) fixed to the fixed part 52 and to movable arm 44, respectively, and provides electrical signals further to the displacing of feeler 40 and of arm 44. A different type of transducer can be used for detecting the above mentioned displacements, as, for example, a strain gauge coupled to armset 50 at the flexible portion with smaller thickness 54, for providing electrical signals as a consequence of the bending of the portion 54.

Furthermore, armset 50 of gauging head 33 can be made in a different way, for example not integrally, and the axis of rotation for movable arm 44 can be defined by fulcrum means of a known type, different from the flexible portion 54.

A metal gasket 60, of a substantially tubular shape, has ends coupled to armset 50, and houses arm-set 50 itself, apart from the free end of arm 44, carrying feeler 40. A portion of gasket 60 has a bellows type structure for providing flexibility, allowing arm 44 to displace.

Adapters 62, 63, 64, 65 are secured to the free ends of arms 44–47 by means of pairs of screws 66, and carry feelers 40–43, for example by means of adjustable threaded couplings, as shown in FIG. 5.

The means for controlling the machining further comprise a processing and control unit 68, electrically connected to the gauging heads 33–36 and to various parts of the machine, in a way that is not shown in the figure, for receiving the electrical signals of transducers 58 and for controlling machine displacements, in particular reciprocal displacements of shoes 6, 8 for approaching towards/displacing away from each other (by means of drive devices 26) and reciprocal displacements between structure 4 and workpiece 2 to be machined (according to the operation hereinafter described), and other possible adjustments of parts of the machine, on the grounds of the results of the signal processing.

Support element 32, as shown in FIG. 5, substantially consists of a main body 70, with a flat shape, and two support flanges 71, 72 that are substantially perpendicular to the main body 70, and define through holes 73 for the positioning and for the clamping of heads 33–36 by means of the pairs of screws 38.

The main body 70 defines an internal surface 75 and includes a central portion 74, with a larger thickness, for reference and clamping purposes and an internal contact surface 76 that lies in a different plane, protruding with respect to the internal surface 75. Central portion 74 comprises transversal reference surfaces 77, and two overhangs 78, 79 that define radial reference surfaces, and a pair of through holes 80 for securing support element 32 to shoe 6. Shoe 6 has suitable openings and seats for housing the detecting device 30, more particularly: a first seat 82, substantially C shaped, defined in a side of shoe 6 for housing both the main body 70 and two oppositely arranged gauging heads 33 and 34; second reciprocally parallel seats 84, 85, for housing the oppositely arranged gauging heads 35 and 36, respectively; through openings 86, 87, located between the first seat 82 and each of the second seats 84, 85, for housing the support flanges 71, 72; and a central coupling recess 88, arranged in a central position of the first seat 82, for housing and positioning the central clamping portion 74 of element 32. At a position corresponding to recess 88, shoe 6 defines a rest surface 89 and a pair of threaded holes 90. Two clamping screws 92 are fitted in the pair of holes 80 of the central portion 74, and inserted in the pair of threaded holes 90, for clamping the support element 32 to shoe 6.

The detecting device 30 can be mounted on shoe 6 by the following sequence of operations: 1) heads 33 and 34 are positioned with respect, and fixed, to flanges 71, 72 by means of screws 38, fitted in the associated holes 73; feelers 40, 41 are in this way oppositely arranged; 2) support element 32, together with gauging heads 33 and 34, is located in seat 82 and in openings 86, 87, positioned by means of the cooperation between the central portion 74 (surfaces 77 and overhangs 78, 79) and surfaces of recess 88, and clamped by means of screws 92; 3) gauging heads 35, 36 are positioned with respect, and fixed, to flanges 71, 72 by means of screws 38, fitted in the associated holes 73, and are housed in seats 84, 85 of shoe 6, with feelers 42, 43 arranged reciprocally opposite.

The operation of the machine shown in FIGS. 1–5 is the following.

Workpiece 2 is supported and positioned along a longitudinal axis by known means not shown in the figures, and rotating elements 14, 16 of the machining structure 4 are rotated by device 26, under the control of unit 68, for bringing shoes 6, 8 towards each other, towards workpiece 2 until reaching a working position whereby the mechanical reference surfaces 10, 12 grip surface 1, while surface 12 of shoe 8 presses a section of the abrasive belt 18 against the surface 1 to be machined. In this working position, the pairs of feelers 40, 41 and 42, 43, respectively, are located at positions corresponding to two parallel cross-sections of surface 1 of workpiece 2 (marked in FIG. 3 with dashed lines S1 and S2), thus the feelers of each pair 40, 41 and 42, 43 are in contact with diametrically opposite areas of each of the sections S1, S2.

In a first setting up phase, the hereinbefore mentioned operations are carried out on a master piece 2 with a cylindrical surface 1 that has known diametral dimensions, preferably identical to the nominal dimensions that the workpiece is expected to have when machining is completed. In this phase, first there occurs a mechanical zero setting operation, in the course of which the position of feelers 40–43 is adjusted, then an electric zero-setting is carried out by operating suitable controls of the processing unit 68 for defining a relation between a mechanical reference position of feelers 40–43 and the associated electrical signals transmitted by transducers 58 and processed in unit 68.

Once the setting up operations have been completed, the master piece is replaced with a workpiece 2 to be machined, and the shoes 6, 8 are brought into contact with the associated cylindrical surface 1.

Then, workpiece 2 is made to rotate about the longitudinal axis—through known means not shown in FIG. 1, but substantially similar to those shown in FIG. 6 and hereinafter described—so starting the microfinishing operations. The global displacement that workpiece 2 and machining structure 4 perform may furthermore comprise limited reciprocal oscillations in longitudinal direction. During the rotation, the diametral dimensions of the cylindrical surface 1 at two different cross-sections S1, S2 (or within a limited portion including these cross-sections, defined by the entity of the aforementioned longitudinal oscillations) are checked by processing the electrical signals provided by transducers 58 of the pairs of gauging heads 33, 34 and 35, 36. By further processing these electrical signals, for example, by comparing the signals from one (33, 34) and from the other (35, 36) of the pairs of heads, unit 68 can detect any possible taper errors on surface 1.

Furthermore, when unit 68 detects the reaching of the required diametral dimension, on the basis of the signals provided by just one (33, 34) of the two pairs of heads, it sends a control to stop the machining, in order to stop, for example, the rotation (and possible oscillation) of workpiece 2; in other terms for releasing the pressure applied by shoes 6, 8 on surface 1, thus reciprocally displacing the rotating elements 14, 16 away from each other.

The method of checking the machining process by unit 68, as hereinbefore outlined, is just an example of how the signals of heads 33–36 can be utilized for in-process checking dimensions and geometrical characteristics of the cylindrical surface 1. Even the detecting of taper errors can be utilized, for example, for performing in an automatic way adjustments of parts of the machine, for correcting the above mentioned errors, in a way that is strictly bound to the machine structure and that is beyond the scope of the present invention.

It should be realized that, further to elements 14, 16 gripping workpiece 2, and reference surface 10 applying pressure on surface 1, shoe 6 can undergo deformations, that, in particular, tend to displace away from each other the end areas of surface 10. By virtue of the particular coupling existing between support element 32 and shoe 6, that contact each other in a central limited area only (coupling of the central portion 74 to surface 89 of central recess 88, and associated reference abutting surfaces, in particular overhangs 78, 79 located in the above mentioned central area), any possible deformations of shoe 6 are not in practice transmitted to element 32. In this way, the reciprocal positions between the gauging heads of each pair 33, 34 and 35, 36 are not altered, hence guaranteeing a correct detecting of the checked diametral dimensions.

It is obvious that the coupling between support element 32, that supports heads 33–36), and the shoe 6 can be made in a different way with respect to the one that has been illustrated, as an example, in the figures, and in particular portion 74 and coupling recess 88 can be replaced by surface portions and mechanical references constructed in a different way, and anyway such as to guarantee a coupling in a single limited central area. Moreover, the extremely small dimensions of the assembly comprising shoe 6 and device 30 enable an in-process checking of the machining in the microfinishing machine, overcoming any problems relating to particularly limited space and accessibility, for the reason that these dimensions, in particular along the axial direction of surface 1 to be checked, substantially do not extend beyond the thickness of shoe 6. The constructional and applicableness simplicity of device 30 guarantee, moreover, considerably limited costs.

It should also be realized that seats 82, 84, 85 and openings 86, 87, defined in shoe 6, that contribute to limit the overall dimensions of the machining structure 4 to extremely limited terms, can increase the compliance and the deformations of shoe 6 itself. However, this aspect is of no influence, thanks to the specific coupling of support element 32 to shoe 6 occurring in an area of limited extension, thus providing the hereinbefore mentioned advantages.

Figure 6:
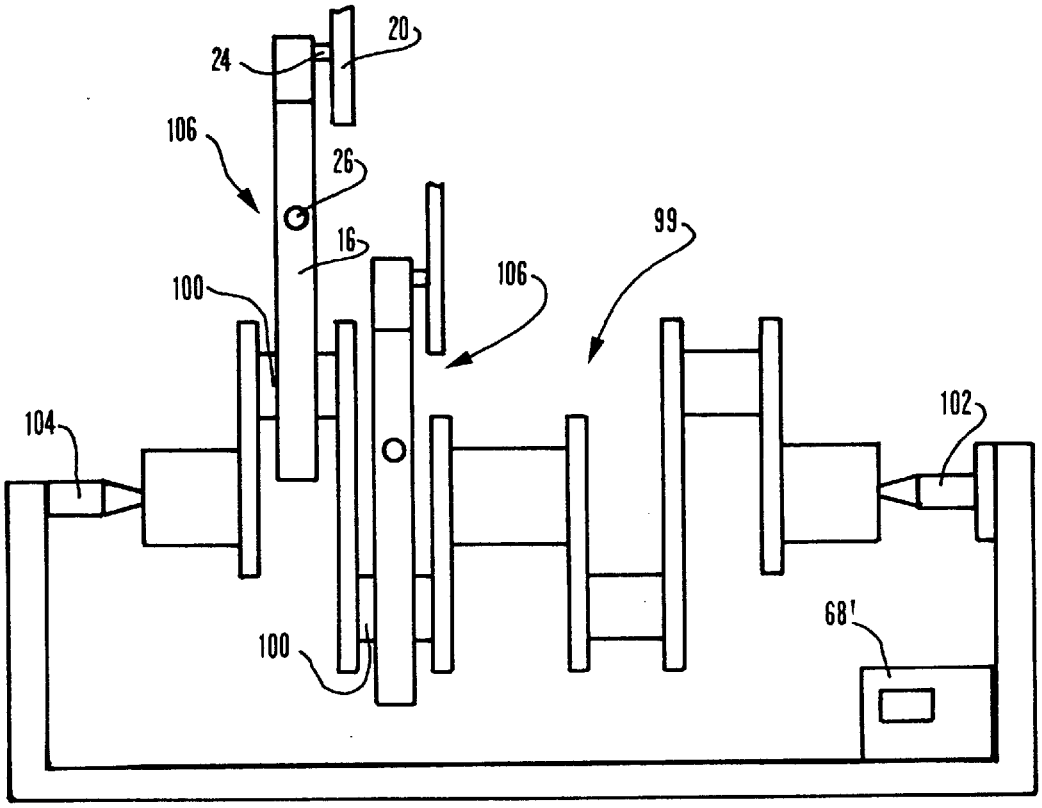
FIG. 6 is a schematic front view of a microfinishing machine tool, in a specific application.

The machine shown in FIG. 6 for machining the crankpins 100 of a crankshaft 99 comprises means for supporting and for driving the shaft, schematically shown by a center 102 and a tailstock 104, that define a longitudinal axis of rotation along which the crankshaft 99 is arranged, and machining units 106 coupled to associated articulated devices of a known type, not shown in the figure, that enable each unit 106 to perform the machining of an associated crankpin 100 rotating in an eccentric manner, in the course of the rotations of shaft 99 about the longitudinal axis (just two units 106 are shown in the figure). The support and drive means 102, 104 are connected to a processing and control unit 68', for controlling these rotations, and possible longitudinal oscillations, as previously mentioned with reference to FIG. 1.

Each machining unit 106 has a structure similar to the one illustrated in FIG. 1, comprising a pair of shoes 6, 8, an abrasive belt 18, rotating elements 14, 16 coupled to a frame 20, and a detecting device 30 coupled to shoe 6.

The operation of the machine according to the application shown in FIG. 6 is similar to that of the machine of FIG. 1. However, this application enhances some advantages that the present invention provides, in particular the possibility of achieving with extremely simple and inexpensive means, thanks to the small overall dimensions of the detecting device 30, a particularly reliable in-process checking of the diametral dimensions and of other geometrical characteristics, like taper, of workpiece 2, without interfering with the customary machining operations of the machine tool through significant problems of mechanical nature and problems due to overall dimensions.

A device according to the invention may obviously be applied to a microfinishing machine with constructional details differing from those shown in the figures, for example comprising a shoe (6) with a mechanical reference surface, cooperating with a workpiece 2, of a different shape with respect to the illustrated cylindrical surface (for example a reference "Vee" ).

Figure 2:
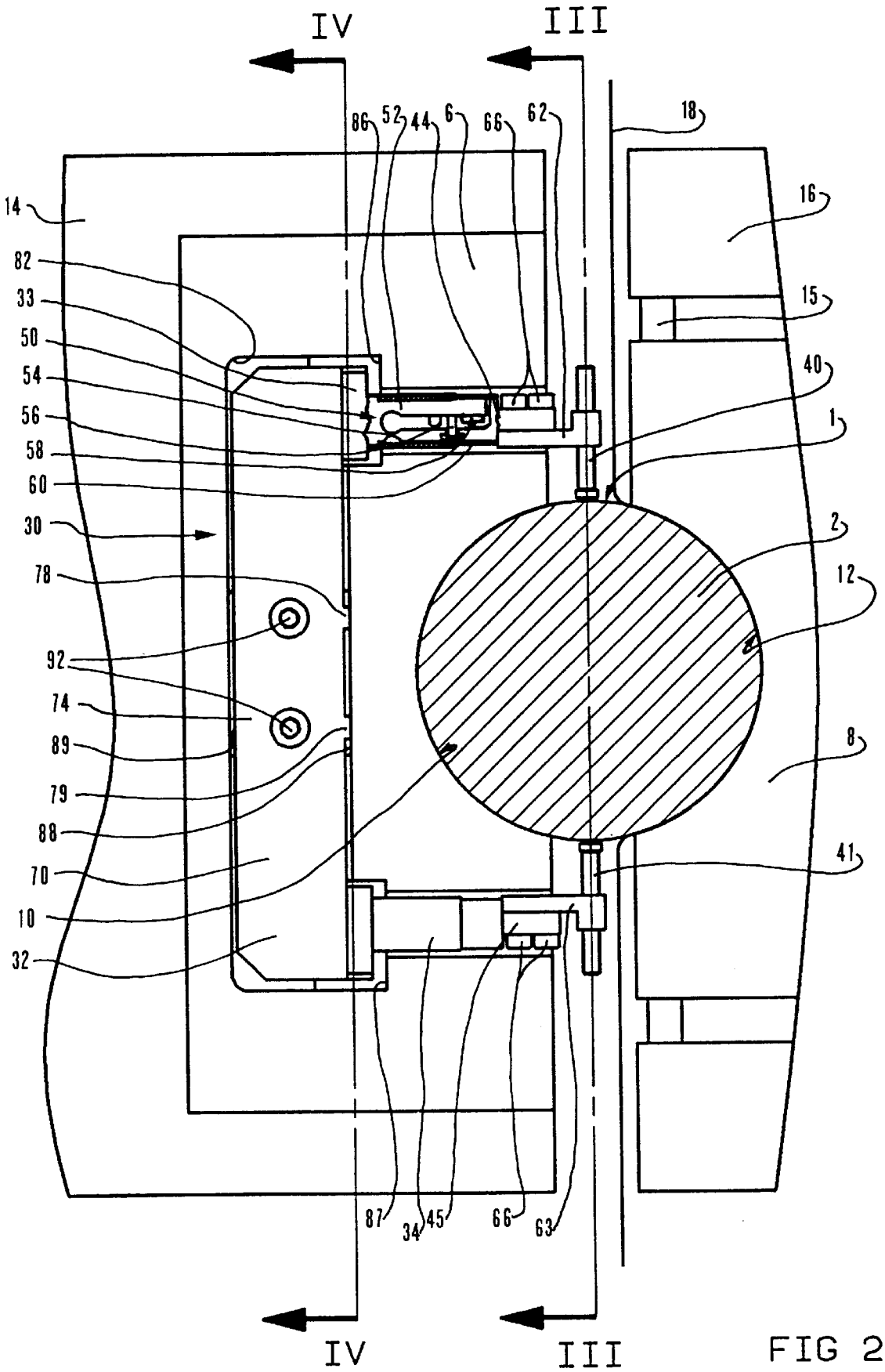
FIG. 2 is an enlarged scale side view, partly cross-sectioned, of a detail of the machine shown in FIG. 1, showing a device according to the present invention.
Figure 4:
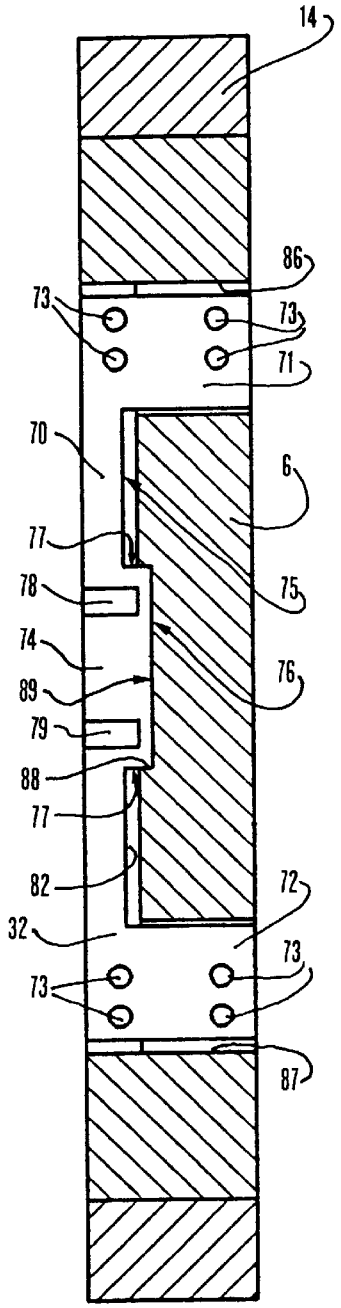
FIG. 4 is a second cross-sectional longitudinal view of the detail of FIG. 2, along line IV—IV in FIG. 2.
Figure 3:
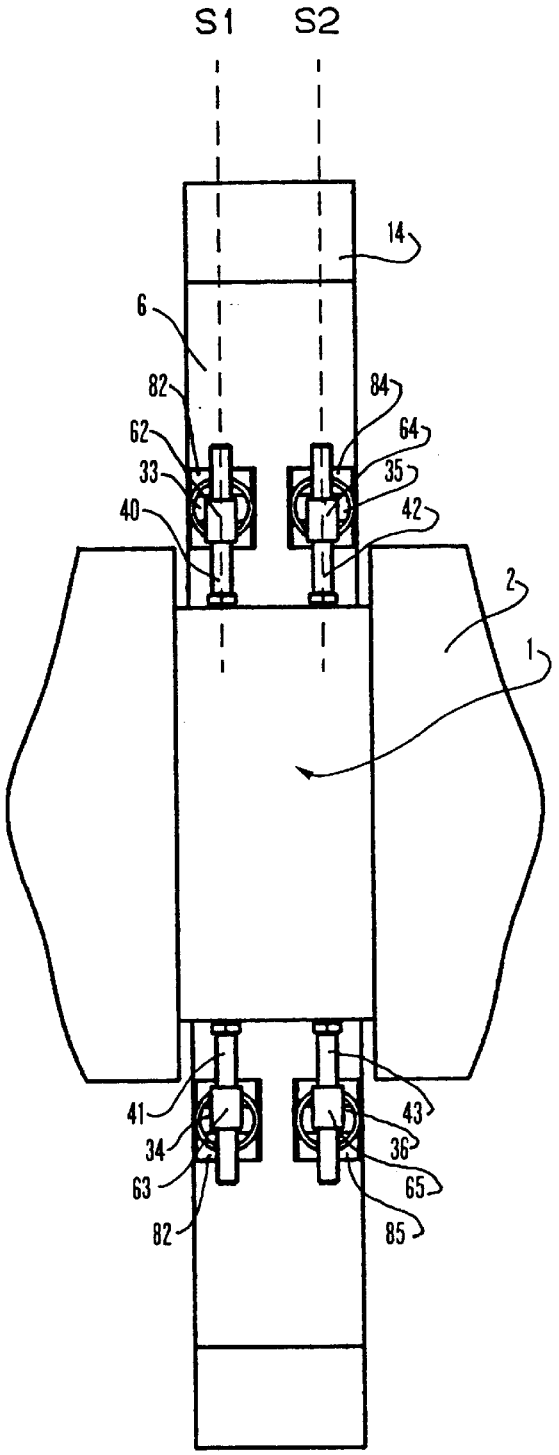
FIG. 3 is a first cross-sectional longitudinal view of the detail of FIG. 2, along line III—III in FIG. 2.

A device according to the present invention may have just one pair of gauging heads, for example heads 33, 34 that detect diametral dimensions in a single cross-section, substantially according to what is shown in FIG. 2. The advantages offered by the particular coupling of the support element 32 in a limited area of shoe 6, and the possibility of limiting the overall dimensions of the machining structure 4 are exactly the same as those previously outlined with regard to the illustrated device comprising two pairs of heads.

According to a further embodiment of the invention a machine may comprise two abrasive belts, similar to belt 18, pressed against surface 1 by both shoes 6 and 8. A similar embodiment, that is not shown in the figures, foresees the use of known adapter elements, different from elements 62–65 shown in FIG. 5, for enabling feelers 40–43 to touch surface 1 without interfering with the belt pressed by shoe 6.

I claim:

1. A device for checking the dimensional characteristics of a rotationally symmetric surface of a workpiece, during the course of the machining in a microfinishing machine that comprises at least two movable shoes and at least an abrasive belt, arranged between one of the shoes and the workpiece, with at least one pair of gauging heads each head comprising one movable feeler, the feelers of said gauging heads being adapted for contacting two diametrically opposite portions of the cylindrical surface to be checked at a cross-section of said cylindrical surface, each gauging head comprising a transducer for providing electrical signals depending on the position of the movable feeler, and a processing unit, electrically connected to the gauging heads for receiving and processing said electrical signals, wherein the device comprises a support element, including a central coupling portion, the support element being coupled at said central coupling portion to one of the shoes, in a central limited area of the shoe, and the gauging heads of said one pair are coupled to the support element in positions oppositely arranged to each other outside said central coupling portion.

2. A device according to claim 1, for checking taper errors on a cylindrical surface (1), comprising a further pair of gauging heads (35,36), that are substantially similar to the gauging heads (33,34) belonging to said at least one pair and are also coupled to the support element (32), in such positions whereby the associated feelers (42,43) can contact diametrically opposite portions at a different cross-section (S2) of the cylindrical surface to be checked (1).

3. A device according to claim 2, wherein each gauging head (33,34;35,36) belonging to each of said pairs is fixed to the support element (32) beside a gauging head (35,36;33,34) belonging to the other pair.

4. A device according to claim 3, wherein the support element (32) has a main body (70), comprising said central coupling portion (74), and two support flanges (71,72), at opposite ends of the main body (70), the gauging heads (33,34;35,36) belonging to each pair being fixed to one and to the other of said support flanges (71,72).

5. A device according to claim 4, wherein said main body (70) has transversal reference surfaces (77) and radial reference overhangs (78,79) at said central coupling portion (74).

6. A device according to claim 1, wherein each gauging head (33,34;35,36) comprises a substantially integral arm-set (50) defining a fixed part (52) coupled to the support element (32), a movable arm (44) carrying said feeler (40–43), and a flexible portion with smaller thickness (54) for enabling displacements of the movable arm (44) with respect to the fixed part (52).

7. A device according to claim 6, wherein said transducer (58) is of the inductive type.

8. A device according to claim 7, wherein each gauging head (33,34;35,36) comprises a tubular metal gasket (60), for housing said transducer (58) and part of said substantially integral arm-set (50).

9. A microfinishing machine tool for machining cylindrical surfaces of a workpiece, comprising, means for supporting and for driving the workpiece, adapted for defining a longitudinal axis of rotation and causing rotational displacements of the workpiece about said axis, at least an abrasive belt for machining the surface of the workpiece, a machining structure, with two oppositely arranged shoes bearing mechanical reference surfaces for the surface to be machined, the shoes being adapted to symmetrically approach to, and displace away from, each other for pressing the abrasive belt against the surface to be machined, and control means with a control and processing unit for controlling the displacements of the shoes and of the workpiece, and a detecting device including a support element, with a central coupling portion, coupled to one of the shoes at a central limited area of the shoe and at least a pair of gauging heads coupled to the support element, in positions oppositely arranged to each other outside the central coupling portion, each comprising, a movable arm, a feeler coupled to an end of the movable arm, fulcrum means enabling displacements of the movable arm with respect to the support element, and a transducer providing to the processing and control unit electrical signals depending on the position of the feeler.

10. A microfinishing machine tool according to claim 9, wherein said shoe (6), to which the support element (32) is coupled, defines housing seats (82,84,85), the detecting device (30) being housed in said seats (82,84,85).

11. A microfinishing machine tool according to claim 10, wherein the detecting device (30) comprises two pairs of gauging heads (33,34;35,36) coupled to said support element (32), the feelers (40,41;42,43) of the two pairs of heads (33,34;35,36) being adapted to cooperate with the surface to be machined (1) at a first and a second pair of diametrically opposite areas of said surface (1), respectively.

12. A microfinishing machine tool according to claim 11, wherein said shoe (6), to which the support element (32) is coupled, defines through openings (86,87), the support element (32) comprising two support flanges (71,72) partially housed in said through openings (86,87), the gauging heads (33,34;35,36) belonging to each of said two pairs being fixed to one and to the other of support flanges (71,72).

13. A machine according to claim 12, wherein said support element (32) of the detecting device (30) comprises a central coupling portion (74), the associated shoe (6) comprising a central recess (88) for defining said central limited zone.

14. A device for checking dimensional characteristics of a rotationally symmetric surface of a workpiece during the course of machining in a microfinishing machine that comprises at least two movable shoes and at least an abrasive belt, arranged between one of the shoes and the workpiece, with a support element coupled to one of the shoes and including a main body having a substantially flat shape with a central coupling portion and opposite ends lying outside the central coupling portion, and two support flanges at said opposite ends, arranged substantially perpendicular to the main body, said central coupling portion being fixed to a central limited area of the shoe, at least two gauging heads, respectively fixed to said two support flanges and having movable feelers for contacting diametrically opposite portions of the cylindrical surface to be checked at a cross-section of said cylindrical surface, each of said two gauging heads comprising a transducer for providing electrical signals depending on the position of the relative movable feeler, and a processing unit, electrically connected to the two gauging heads for receiving and processing said electrical signals.

15. A device for checking the dimensional characteristics of a rotationally symmetric surface of a workpiece during the course of the machining in a microfinishing machine which comprises at least two movable shoes and at least an abrasive belt, arranged between one of the shoes and the workpiece, with at least one pair of gauging heads each head comprising one movable feeler, the feelers of said gauging heads being adapted for contacting two diametrically opposite portions of the rotationally symmetric surface to be checked at a cross-section of said rotationally symmetric surface, each gauging head and movable feeler set comprising a transducer for providing electrical signals depending on the position of the movable feeler, wherein the device comprises a support element for supporting the gauging heads, the support element including a central coupling portion and being coupled at said central coupling portion to one of the shoes, in a central limited area of the shoe.

* * * * *